US005277509A

United States Patent [19]

Danehy

[11] Patent Number: 5,277,509

[45] Date of Patent: Jan. 11, 1994

[54] DEVICE FOR APPLYING PAINT TO PAINTING PAD

[76] Inventor: Ray G. Danehy, 2440 16th St., Rm. 144, San Francisco, Calif. 94103

[21] Appl. No.: 950,943

[22] Filed: Sep. 24, 1992

[51] Int. Cl.[5] ..... B05C 17/03; B05C 1/02

[52] U.S. Cl. ..... 401/208; 401/218; 118/252; 118/258; 118/DIG. 15; 15/257.06; 15/99

[58] Field of Search ..... 401/208, 218, 21, 126; 15/257.05, 257.06, 99; 118/DIG.; 101/331, 329

[56] References Cited

U.S. PATENT DOCUMENTS

| | | | |
|---|---|---|---|
| 154,195 | 8/1874 | Smith | 401/208 |
| 951,562 | 3/1910 | Hamelstrom | 118/DIG. 17 X |
| 2,297,107 | 9/1942 | Magnuson | 15/99 |
| 2,688,305 | 9/1954 | Wray et al. | 118/246 X |
| 2,982,948 | 5/1961 | Discipio | 401/208 |
| 3,648,322 | 3/1972 | Meisner | 15/257.05 |
| 4,083,466 | 4/1978 | McManaway | 15/257.06 |
| 4,106,434 | 8/1978 | Vines | 118/258 |
| 4,107,815 | 8/1978 | Dumesnil | 15/257.05 |
| 4,112,536 | 9/1987 | Carson et al. | 401/208 X |
| 4,164,803 | 8/1979 | Zurawin | 15/257.05 |
| 4,182,786 | 1/1980 | Hertel | 118/258 X |
| 4,767,229 | 8/1988 | Cha | 401/208 |

*Primary Examiner*—Danton D. DeMille

[57] ABSTRACT

An applicator for applying paint to a painting pad with no need to pour any paint from the original paint can. The applicator comprises a conventional standard paint can with a lid and a sleeve with upper and lower surfaces to effect a seal between the paint can and the paint can lid. The sleeve rotatively supports a roller which carries a free hanging, flexible, endless paint transfer belt and weight. The belt encircles the roller and the weight. The weight pulls the belt tight and near to the bottom of the paint can. The paint is applied to a painting pad by moving the painting pad across the paint transfer belt and support roller causing the roller to rotate and move the transfer belt down through the paint to the bottom of the can and back up, thereby picking up paint and transferring it to the painting pad. With the paint can lid in place, the applicator and unused paint may be conveniently stored. The applicator may be easily cleaned of water-based paint by placing it in a paint can filled with water and, after sealing the lid, agitating all parts without any spillage or contact.

7 Claims, 3 Drawing Sheets

DEVICE FOR APPLYING PAINT TO PAINTING PAD

BACKGROUND

1. Field Of Invention

This invention relates to painting equipment, especially to items for use in applying the proper amount of paint to a painting pad and conserving paint.

2. Description Of Prior Art

The use of trays to hold paint during painting operations is well known. Such devices were mainly used with roller applicators until painting pads having a flat, resilient pad covered by small, outwardly extending bristles came into use.

However using a tray, only the most skillful painter can get just the right amount of paint on a painting pad for satisfactory paint application. The amount is especially critical for specialized pad-type devices for cutting-in, that is for painting one surface up to an adjoining surface without putting paint on the adjoining surface, which work only if the proper amount of paint may easily be applied to them. Once too much paint is applied to a cutting-in tool, it must be cleaned or smears result which ruin the appearance of both the area being painted and the adjacent area being cut-in.

A number of devices have improved upon this situation by providing a paint transferring roller to apply a proper amount of paint to the painting pad, among other things. Some of these devices are shown in the following patents:

| U.S. Pat. No. | Issued | To |
|---|---|---|
| 4164803 | 8/21/79 | Zurawin et al |
| 4107815 | 8/22/78 | Dumenil, Jr. |
| 4106434 | 8/15/78 | Vines |
| 3648322 | 3/14/72 | Meisner |

However, all of these devices have the disadvantage of requiring a tray as the paint reservoir. A tray is undesirable for the following reasons:

A) It is necessary to pour paint from the original paint container into this tray, this results in paint loss through spillage and retention in the tray.

B) It is necessary to eventually clean the tray for reuse.

C) Extra drop-cloth protected work space is needed to utilize the tray.

D) Extra care must also be taken to avoid upsetting the low profile tray and spilling paint which can be tracked around on the soles of one's shoes.

E) The tray must be repeatedly replenished with paint to maintain proper tray paint level. Otherwise, in most cases, the depth of paint in the tray determines the amount of submersion of the transfer roller and consequently the amount of paint picked up by the transfer roller which is subsequently applied to the painting pad. This results in a variable application of paint unless proper tray paint level is maintained.

Also, the devices do not provide a convenient means to store the assembled device and unused paint without exposure to the air, causing the paint to dry out. No provision is made to easily clean and store the device for a long term.

Objects And Advantages

Accordingly several objects of my invention are to provide a device which allows an unskilled person to apply a proper amount of paint to a conventional painting pad, which eliminates subsequent paint splatter, dripping, or runs and the need to use extensive drop cloths while painting. Specialized pad-type cutting-in devices will work effectively because the proper amount of paint may easily be applied to them. Otherwise, once too much paint is applied to a cut-in tool, it must be cleaned or smears result.

Also my device eliminates the need to pour any paint out of the original container as device utilizes a standard paint can as the paint reservoir. This reduces paint loss as there is no spillage or paint retention from an added reservoir. Paint is conserved.

The amount of clean-up is reduced by eliminating paint pouring spills or the need to clean a separate paint reservoir.

No working space is needed for a separate paint reservoir.

The device can be easily stored with the unused paint, utilizing the original container and lid. No transferring of paint or clean-up is required.

The device can be quickly put to use when removed from storage with unused paint. No transferring of paint, spillage, or paint loss need occur.

There is no need to repeatedly add paint. The device effectively utilizes almost all of the paint in the standard paint can.

The device may be easily cleaned of water-based paint, utilizing a water-filled standard paint can and lid. The sealed items may be shaken to agitate them without any spillage or contact. After this cleaning, the device may then be stored for long term by simply pouring off the water and sealing the lid.

Further objects and advantages of my invention will become apparent from a consideration of the drawings and ensuing description of it.

DESCRIPTION OF DRAWINGS

The above and other features of my invention will be better understood by those skilled in the art with reference to the following detailed description and the accompanying drawing in which.

List Of Reference Numerals

Figure 1:
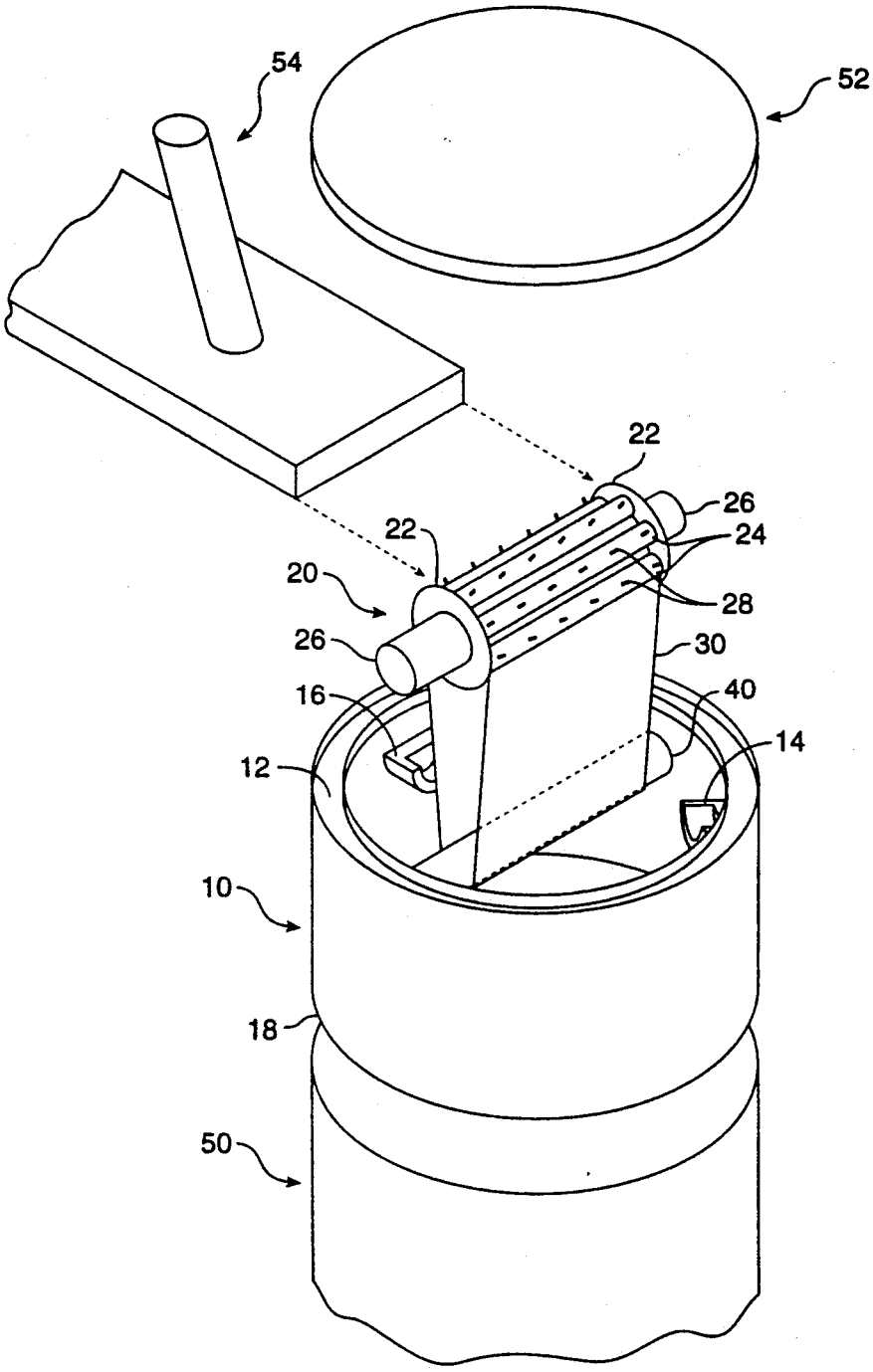
FIG. 1 is a somewhat exploded perspective view of a device made according to the invention.

10 sleeve
12 groove in 10
14 support on 10
16 rest on 10
18 bead of 10
20 roller
22 collar of 20
24 rib of 20
26 stub of 20
28 teeth of 20
30 transfer belt
40 weight
50 standard paint can
52 standard can lid
54 painting pad
56 paint surface

DESCRIPTION OF INVENTION

FIG. 1 shows an overall view of a paint-applying device or applicator for applying paint to a painting pad according to the invention. The applicator comprises a cylindrical sleeve 10 which is made of a suitable material, such as plastic or conventional can metal, and is sized to fit a standard paint can 50, as shown more clearly in FIG. 3. The applicator has on its upper surface a groove 12 properly formed so that a standard can lid 52 can make a hermetic seal with sleeve 10. Also sleeve 10 has on its lower surface a bead 18 properly formed so that it will make a hermetic seal with the rim of can 50.

Figure 2:
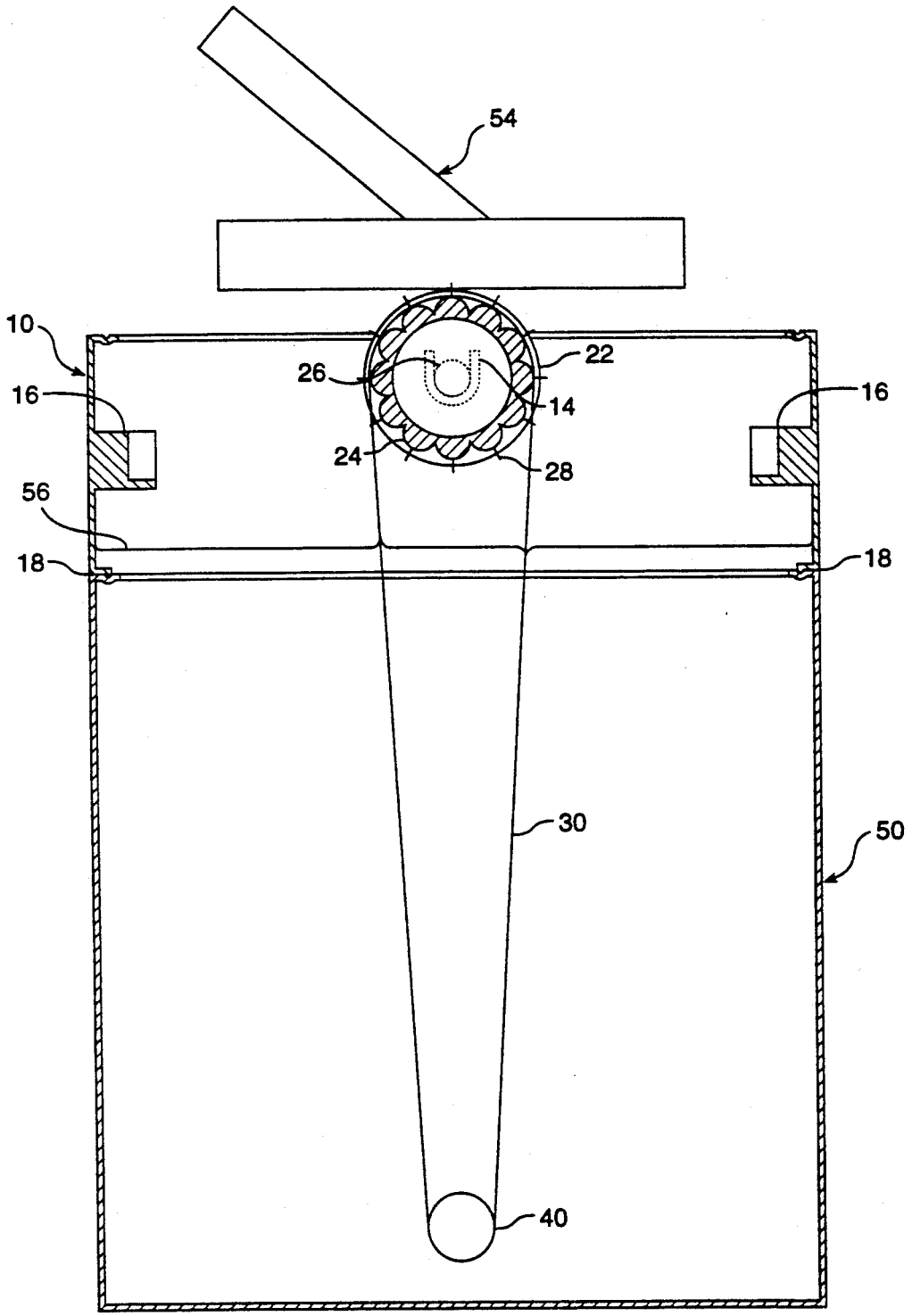
FIG. 2 is a partial cross-section of the device while assembled for applying paint to painting pad.
Figure 3:
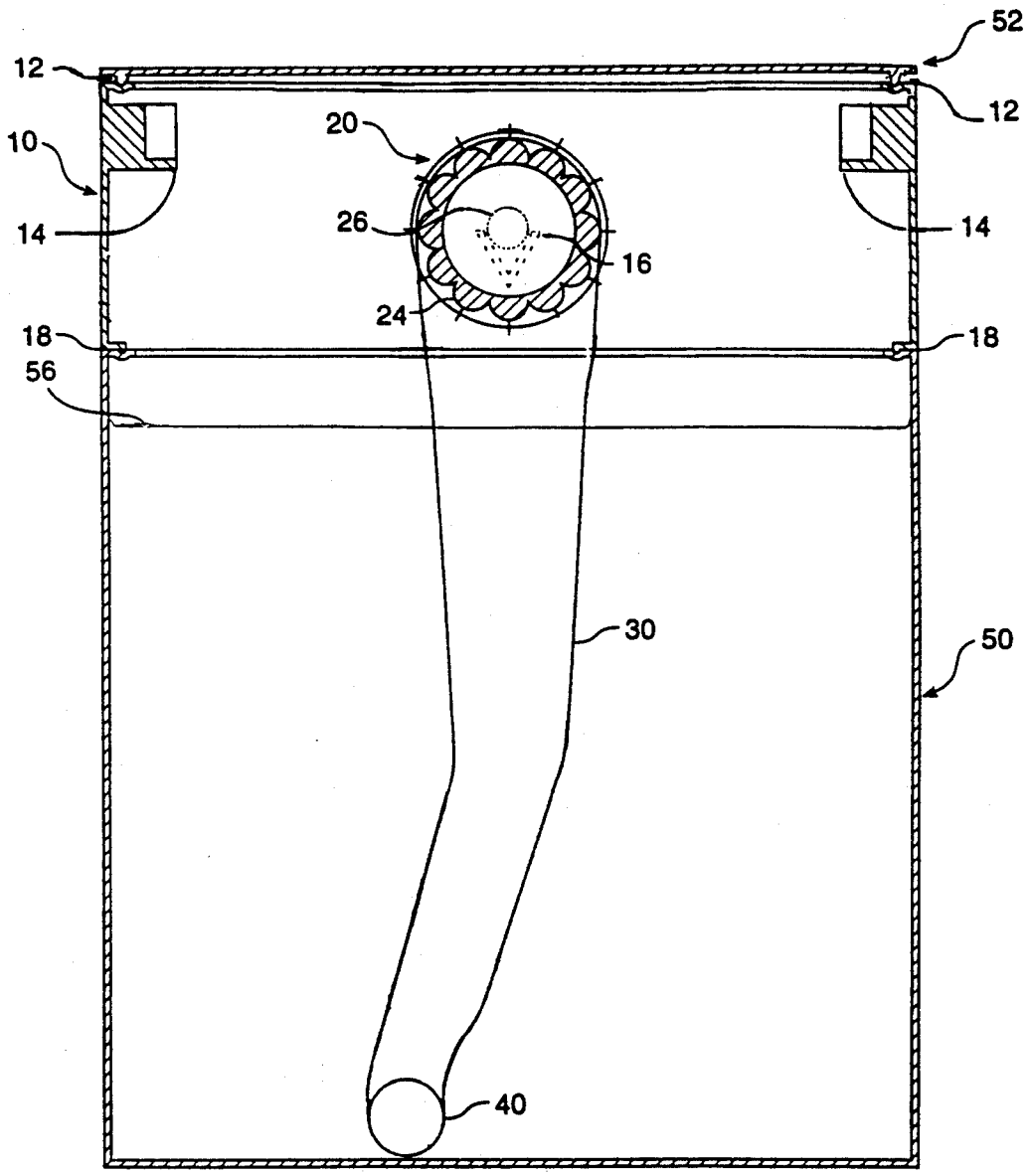
FIG. 3 is a partial cross-section of the device while assembled for storing.

As shown in FIGS. 1 to 3, sleeve 10 also includes two diametrically opposed U-shaped inwardly protruding supports 14. Supports 14 are dimensioned and oriented as to support two axle stubs 26 which extend from the ends of roller 20, allowing roller 20 to rotate freely.

Sleeve 10 also includes two diametrically opposed V-shaped inwardly protruding rests 16. Rests 16 are dimensioned and oriented as to hold axle stubs 26.

The applicator also includes a roller 20 made of suitable material, such as plastic or metal with non-corrodable coating, about 5 cm in diameter, and sized and shaped to fit within sleeve 10. Roller 20 has a centered axial length between two collars 22 to accommodate the width of a conventional painting pad 54. The radius of collars 22 exceeds the radius of rib 24 by at least the thickness of a transfer belt 30. Between collars 22, roller 20 is cylindrically shaped and has longitudinal ribs 24 and teeth 28. Teeth 28 are spaced to register with holes in web of transfer belt 30 and are long enough to pass through the transfer belt 30 and contact painting pad 54.

As shown in FIGS. 1 and 3, the device also includes a transfer belt 30 consisting of a suitable, flexible, webbed material configured as an endless belt sized in width to fit between collars 22. Belt 30 may be made from currently available common drywall tape made of plastic filaments formed into a long webbed strip. The strip can be made into the proper length endless belt by gluing overlapping ends together.

As shown in FIGS. 1 and 2, the length of transfer belt 30 is such that while supporting a weight 40 and positioned with other parts of the device for applying paint, the lower surface of belt 30 clears the inside of can 50. E.g., the circumference of belt 20 may be about 55 cm long.

The applicator also includes a bar-shaped weight 40 made of suitable material, such as steel with a non-corrodable coating, sized to closely fit through sleeve 10, shaped to easily rotate. Weight 40 weighs about 0.2 kg so as to suitably tension belt 30.

Operation Of Applicator

The applicator of FIG. 1 will provide the following functions:

A) It will apply the proper amount of paint to a painting pad 54 when assembled as in FIG. 2.

B) It will store itself with the unused paint in a convenient manner when assembled as in FIG. 3.

C) One can clean the applicator of water-based paint for long-term storage when assembled as in FIG. 3 on a standard paint can 50 filled with water and vigorously agitated.

D) One can conserve paint by making it unnecessary to pour paint from the original can 50 to other containers with the accompanied spillage and paint retention.

To apply the proper amount of paint to a painting pad 54, lid 52 is removed from a new or used can 50 full or partly filled with paint. As shown in FIG. 2, sleeve 10 is placed on can 50 and pressed down so that bead 18 seals with the mating surface of can 50.

As will be shown, this mating seal is important so that no paint will leak out when the surface 56 of a full ca of paint 50 rises above the level of bead 18 as parts of the applicator are subsequently lowered into the paint. Thus a full can of paint 50 need not be partially emptied to accommodate the applicator. Also, the seal allows some additional paint from another container to be added, as the original container and sleeve 10 can hold more than the standard amount.

While holding a stub 26 of roller 20 by hand, transfer belt 30 is slipped over roller 20 and located between collars 22 and allowed to hang free, as shown in FIGS. 1 and 2.

Teeth 28 register with holes in the web of transfer belt 30 and pass through transfer belt 30. The purpose of teeth 28 is to engage transfer belt 30 with roller 20 so that they move together without slipping and to provide frictional contact with painting pad 54. Collars 22 keep transfer belt 30 centered on roller 20 and prevent paint from axially flowing past collars 22.

With the free opposite hand, weight 40 is inserted and centered inside belt 30 below roller 20 and allowed to come to rest. The hand holding weight 40 is now released and grasps the remaining unsupported stub 26 of roller 20. As shown in FIG. 1, roller 20, transfer belt 30, and weight 40 can be lowered into sleeve 10 until stubs 26 are supported by supports 14. This should be done while holding roller 20 horizontal and lowering the items slowly so that weight 40 keeps tension on belt 30. This steadies weight 40 in place on belt 30 and keeps belt 30 in place on roller 20.

As shown in FIG. 2, weight 40 will tension and pull belt 30 down until it barely clears the bottom of can 50. This is important because belt 30 can now transfer almost all the paint in the can 50 to pad 54.

Weight 40 should be shaped and sized with care for the proper transfer of paint within the viscosity range of interest. Paint viscosities range between lightweight wood stains and heavier gloss enamels.

If weight 40 has too large a diameter, it can cause excessive fluid rotational drag. If weight 40 is too heavy, it can cause excessive mechanical rotational drag of roller 20 rotating in support 14. With too much drags painting pad 54 cannot easily rotate roller 20.

A solid cylindrical weight 40 of approximately 2 cm diameter has been used. The proper tension on belt 30 and physical dimension of weight 40 are necessary to keep the inner surfaces of belt 30 separate. If these inner surfaces come together and adhere, this may create enough drag that belt 30 can no longer move. If the paint's viscosity is too great, the width of belt 30 should be reduced. Adequate paint coverage on pad 54 can still occur using overlapping passes. Normal passes are described below.

The final operation is to move a painting pad 54 across transfer belt 30 in a direction to rotate roller 20 while pressing down lightly. As shown in FIGS. 1 and 2, ribs 24 and teeth 28 act to provide frictional engagement of the painting pad 54 with belt 30 and roller 20. This causes them to move and rotate as pad 54 is moved across them. The movement of belt 30 down through the paint to the bottom and back up picks up paint from can 50 and transfers it to pad 54. Subsequent passes of pad 54 should be in the same direction, not back and forth.

The amount of paint transferred is determined by the number of passes made with pad 54. A proper amount of paint may be applied to pad 54 in approximately two passes.

The user can conveniently store the applicator with unused paint for short periods so that the paint does not dry out. First, the user removes pad 54, and then assembles applicator as shown in FIG. 3, preferably by holding stubs 26 and raising roller 20, along with belt 30 and weight 40. When stubs 26 are clear of support 14, the suspended parts are rotated one quarter turn in a horizontal plane. The suspended parts are then lowered until stubs 26 are held by rests 16 and then released.

Rests 16 are for the purpose of lowering the roller 20 to clear lid 52 and to allow weight 40 to lie on the bottom of can 50. This relieves tension from belt 30 and arrests any stretching.

Finally the user places lid 52 on sleeve 10 and presses down to seal with groove 12. The applicator and unused paint may now be conveniently stored for short periods without the paint drying out.

Cleaning the applicator of water-based paints for long-term storage is accomplished by taking the applicator as stored for short periods, as shown in FIG. 3, and removing lid 52 with assembled device from can 50 and lowering the assembled device onto another can 50 filled with water. After making the seal between bead 18 and can 50, the complete assembly should be vigorously agitated. Since everything is sealed inside, there will be no spillage or need to contact any paint. Then the user drains off the water and repeats the above procedure with fresh water until the water is clear after agitation. The device is now cleaned and may be stored for a long term.

Conclusion Ramifications And Scope

The reader should find that the device provides unskilled people with an easy way to apply the proper amount of paint to a painting pad or pad type cutting-in tool, thus allowing them to perform a paint job of improved quality, without splatter or runs. Also few drop cloths are needed.

This device has the following advantages over prior-art applicators:

The original paint can may be used; no separate tray or reservoir is needed;

The user does no cleaning of a separate tray;

The user does no pouring of paint with resultant spills and clean-up;

Paint is conserved;

The user needs no extra work space for a special tray;

The painter has no need to add paint until it reaches the bottom of the can;

There is no clean-up or transferring of paint before storing the device with unused paint. One can perform a simple turning action and then seal everything up with the can lid;

One can quickly put the device back to use after storage with unused paint;

The painter can readily clean everything of water-based paint while the parts are sealed between a paint can and lid. One simply adds water and shakes everything, and there is no spill.

While my above description contains many specifities, these should not be construed as limitations on the scope of the invention, but rather as exemplifications of one preferred embodiment thereof. Many other variations are possible. For example, along with a locking mechanism to hold sleeve 10 to can 50, a lifting handle may be added. A holder for a paint brush can be placed inside sleeve 10. Rest 16 can have a spring to hold stub 26 and roller 20 to restrain them when being agitated in cleaning. Accordingly, the scope of the invention should be determined not by the embodiment illustrated, but by the appended claims and their legal equivalents.

I claim:

1. An applicator for applying paint from a standard paint can to a painting pad, comprising:

a flexible, endless paint transfer belt of webbed material, a roller carrying said transfer belt, a separating means supported by said roller for keeping inner surfaces of said transfer belt from contacting each other and for guiding said transfer belt, a vertical cylindrical sleeve including a pair of diametrically opposed supports providing half-circle bearing elements which are adapted to support said roller by journaling a pair of opposite ends of said roller, said supports positioned on said sleeve such that when said roller is journaled in said sleeve an upper surface of said roller will extend above said sleeve so as to allow said painting pad to contact said transfer belt without striking said sleeve, said sleeve including a vertical bead on a lower surface of said sleeve to seal with a groove at the top of said standard paint can, thereby permitting said paint can and said sleeve to form a leakproof seal and to immerse part of said transfer belt and said separating means in paint contained in said paint can, said sleeve further includes a pair of diametrically opposed rests which are adapted to support said roller at rest such that said roller is totally contained within the dimensions of said sleeve, said sleeve including a vertical groove on its upper surface to seal with the bead of a standard paint can lid, thereby permitting said lid and said sleeve to form a leakproof seal;

whereby moving said painting pad across said transfer belt causes said roller to rotate and said transfer belt to move through and in contact with said paint and to transfer said paint from said paint can to said painting pad; and whereby mounting said roller on said rest within said sleeve and placing said lid on said sleeve encloses and seals all parts within said paint can, said sleeve and said lid.

2. The applicator of claim 1 wherein said roller contains a plurality of longitudinally and circumferencially spaced teeth radially oriented and extending outwardly from said roller and spaced so as to pass through openings in web of said transfer belt and of sufficient length to engage said painting pad; whereby movement of said painting pad causes said roller to rotate and transfer belt to move.

3. The applicator of claim 1 wherein said roller contains a plurality of longitudinally extending, circumferencially spaced ribs defining longitudinal channels between them and upstanding teeth outwardly extending from said ribs to engage said transfer belt and said painting pad; whereby movement of said painting pad causes said transfer belt to move and said roller to rotate.

4. An applicator for applying paint from a standard paint can to a painting pad, comprising:

a flexible, endless paint transfer belt of webbed material, a free-hanging weight supported by said transfer belt, a roller carrying said transfer belt, a vertical cylindrical sleeve including a pair of diametrically opposed supports providing half-circle bearing elements which are adapted to support said roller by journaling a pair of opposite ends of said roller, said supports positioned on said sleeve such that when said roller is journaled in said sleeve an upper surface of said roller will extend above said sleeve so as to allow said painting pad to contact said transfer belt without striking said sleeve, said sleeve including a vertical bead on a lower surface of said sleeve to seal with a groove at the top of said standard paint can, thereby permitting said paint can and said sleeve to form a leakproof seal and to immerse part of said transfer belt and said weight in paint contained in said paint can, said sleeve further includes a pair of diametrically opposed rests which are adapted to support said roller at rest such that said roller is totally contained within the dimensions of said sleeve, said sleeve including a vertical groove on its upper surface to seal with the bead of a standard paint can lid, thereby permitting said lid and said sleeve to form a leakproof seal;

whereby moving said painting pad across said transfer belt causes said roller to rotate and said transfer belt to move through and in contact with said paint and to transfer said paint from said paint can to said painting pad; and whereby mounting said roller on said rest within said sleeve and placing said lid on said sleeve encloses and seals all parts within said paint can, said sleeve and said lid.

5. The applicator of claim 4 further including a notch adjacent each stubs of said roller so as to mount and journal a pair of collars comprising separate washer-shaped discs with means for retaining said discs in said notches; whereby said collars may rotate independently of roller, and guide said transfer belt between them and may be independently removed from said roller.

6. The applicator of claim 4 wherein said roller contains a plurality of longitudinally and circumferencially spaced teeth radially oriented and extending outwardly from said roller and spaced so as to pass through openings in web of said transfer belt and of sufficient length to engage said painting pad; whereby movement of said painting pad causes said roller to rotate and transfer belt to move.

7. The applicator of claim 4 wherein said roller contains a plurality of longitudinally extending, circumferencially spaced ribs defining longitudinal channels between them and upstanding teeth outwardly extending from said ribs to engage said transfer belt and said painting pad; whereby movement of said painting pad causes said transfer belt to move and said roller to rotate.

* * * * *